US006588817B1

(12) United States Patent
Wadeyka et al.

(10) Patent No.: US 6,588,817 B1
(45) Date of Patent: Jul. 8, 2003

(54) CARRIER FOR SKIS AND SKI POLES

(75) Inventors: Gregory L. Wadeyka, 20 Cooper La., Basking Ridge, NJ (US) 07920; Kenneth Dennison, W. Long Branch, NJ (US)

(73) Assignee: Gregory L. Wadeyka, Basking Ridge, NJ (US)

( * ) Notice: Subject to any disclaimer, the term of this patent is extended or adjusted under 35 U.S.C. 154(b) by 0 days.

(21) Appl. No.: 09/478,785

(22) Filed: Jan. 6, 2000

(51) Int. Cl.[7] ..... A63C 11/02

(52) U.S. Cl. ..... 294/147; 294/162; 211/70.5; 220/524; 220/826

(58) Field of Search ..... 294/147, 159, 294/162, 165; 280/814; 211/70.5; D3/259; 220/507, 524, 819, 826, 844; 224/917, 917.5

(56) References Cited

U.S. PATENT DOCUMENTS

| | | | | | |
|---|---|---|---|---|---|
| 687,664 | A | * | 11/1901 | Smith | 220/524 |
| 1,822,519 | A | * | 9/1931 | Fleck | 220/826 |
| 2,042,086 | A | * | 5/1936 | Aubert | 280/814 |
| 2,133,883 | A | * | 10/1938 | Aubert | 294/147 |
| 2,347,270 | A | * | 4/1944 | Larrson | 220/826 |
| 2,384,850 | A | * | 9/1945 | Poor | 280/815 |
| 3,260,430 | A | * | 7/1966 | Sandenburgh | 280/814 |
| 3,640,420 | A | * | 2/1972 | Carter et al. | 220/826 |
| 3,718,242 | A | | 2/1973 | Larson | 294/147 |
| 3,780,920 | A | * | 12/1973 | Green | 294/147 |
| 3,848,785 | A | * | 11/1974 | Bott | 224/319 |
| 3,892,343 | A | * | 7/1975 | Warner | 294/147 |
| 3,935,977 | A | | 2/1976 | Bonnett | 294/147 |
| 3,985,275 | A | * | 10/1976 | Allen | 294/147 |
| 3,990,655 | A | | 11/1976 | Covell | 294/147 |
| 4,040,551 | A | * | 8/1977 | Brumbaugh | 294/147 |
| 4,057,983 | A | * | 11/1977 | Morgan | 70/58 |
| 4,084,735 | A | * | 4/1978 | Kappas | 224/328 |
| 4,154,274 | A | * | 5/1979 | Adamson | 294/159 |
| 4,190,182 | A | * | 2/1980 | Hickey | 294/147 |
| 4,216,665 | A | * | 8/1980 | McKelvey | 70/58 |
| 4,274,571 | A | | 6/1981 | Lafreniere et al. | 294/147 |
| 4,326,747 | A | | 4/1982 | Finnegan | 294/147 |
| 4,369,883 | A | * | 1/1983 | Stravitz | 220/844 |
| 4,458,935 | A | | 7/1984 | Fields, Jr. | 294/147 |
| 4,479,674 | A | * | 10/1984 | Nordmeyer | 294/165 |
| 4,491,359 | A | * | 1/1985 | Metropulos | 294/147 |
| 4,526,414 | A | * | 7/1985 | Jones | 294/143 |
| 4,613,041 | A | * | 9/1986 | Carlton | 220/524 |
| 4,720,031 | A | * | 1/1988 | Zimmerman | 220/254 |
| 4,804,113 | A | * | 2/1989 | Ciaccio | 220/254 |
| 4,830,403 | A | * | 5/1989 | Ohmori | 294/147 |
| 4,863,082 | A | * | 9/1989 | Evans et al. | 224/917 |
| 5,012,921 | A | | 5/1991 | Becker | 280/814 |
| 5,054,673 | A | * | 10/1991 | Dixon | 224/324 |
| 5,137,195 | A | * | 8/1992 | Walter | 224/315 |
| 5,259,506 | A | * | 11/1993 | Pascale et al. | 220/524 |
| D351,498 | S | * | 10/1994 | Stebbins | D3/259 |
| 5,657,913 | A | * | 8/1997 | Cucheran et al. | 224/319 |
| 6,273,272 | B1 | * | 8/2001 | Hake | 211/70.5 |

* cited by examiner

*Primary Examiner*—Eileen D. Lillis
*Assistant Examiner*—Paul T. Chin
(74) *Attorney, Agent, or Firm*—Duane Morris LLP

(57) ABSTRACT

A hand-held carrier for manually carrying parabolic skis and associated ski poles, the carrier having a double open-ended molded plastic receptacle having a bottom wall, first and second side walls extending up from the bottom wall and a partition wall disposed between the side walls. The walls of the receptacle define first and second elongated compartments each sized especially for holding a section of a parabolic ski and its associated ski-boot binding hardware. First and second molded plastic closures are pivotally coupled to opposing upper portions of the receptacle, for respectively closing the first and second compartments. The closures include integral handle sections which come together to form a single carrying handle when the closures are pivoted to close the compartments.

10 Claims, 4 Drawing Sheets

CARRIER FOR SKIS AND SKI POLES

FIELD OF THE INVENTION

This invention relates to hand-held carriers for skis and ski poles, and in particular, to a hand-held carrier especially adapted for carrying parabolic or shaped skis.

BACKGROUND OF THE INVENTION

The newest trend in skiing has been the introduction of parabolic or shaped skis. Skis of this new design have become extremely popular for downhill skiing because they make turning and carving in snow substantially easier as compared with conventional skis. Moreover, this ski design employs a boot heel plate in the bindings which raises the skier higher on the skis, thereby more evenly distributing the skier's weight over the skis for improved control.

Skiers typically lock and transport their skis and ski poles with hand-held ski carriers. These ski carriers are presently produced in many different designs most of which use a clamping mechanism to hold the skis.

Unfortunately, existing ski carrier designs can not accommodate parabolic or shaped skis because the boot heel plates incorporated in their bindings significantly increase the skis' mid-section width. Further, conventional ski carriers are inconvenient and time consuming to use as the skier must kneel down on the ground to place the skis in the carrier and fold the sides of the carrier together.

Accordingly, a hand-held ski carrier is needed which is capable of carrying parabolic, shaped, or conventional skis and is convenient to use.

SUMMARY OF THE INVENTION

A carrier for carrying skis and associated ski poles, the carrier comprising a receptacle defining first and second elongated compartments each sized for holding a section of a ski and its associated ski-boot binding hardware. The carrier further comprises first and second closures pivotally coupled to upper portions of the receptacle, for respectively closing the first and second compartments.

One aspect of the invention involves proving first and second cavities formed by the receptacle and closures for clamping a pair of ski poles to the carrier.

Another aspect of the invention involves providing the closures with integral handle sections that come together to form a single carrying handle when the closures are pivoted to close the compartments.

Still another aspect of the invention involves forming the receptacle with a generally w-shape.

A further aspect of the invention involves sizing the compartments for parabolic skis.

BRIEF DESCRIPTION OF THE DRAWINGS

The advantages, nature, and various additional features of the invention will appear more fully upon consideration of the illustrative embodiment now to be described in detail in connection with accompanying drawings wherein.

It should be understood that the drawings are for purposes of illustrating the concepts of the invention and are not to scale.

DETAILED DESCRIPTION OF THE INVENTION

Figure 1:
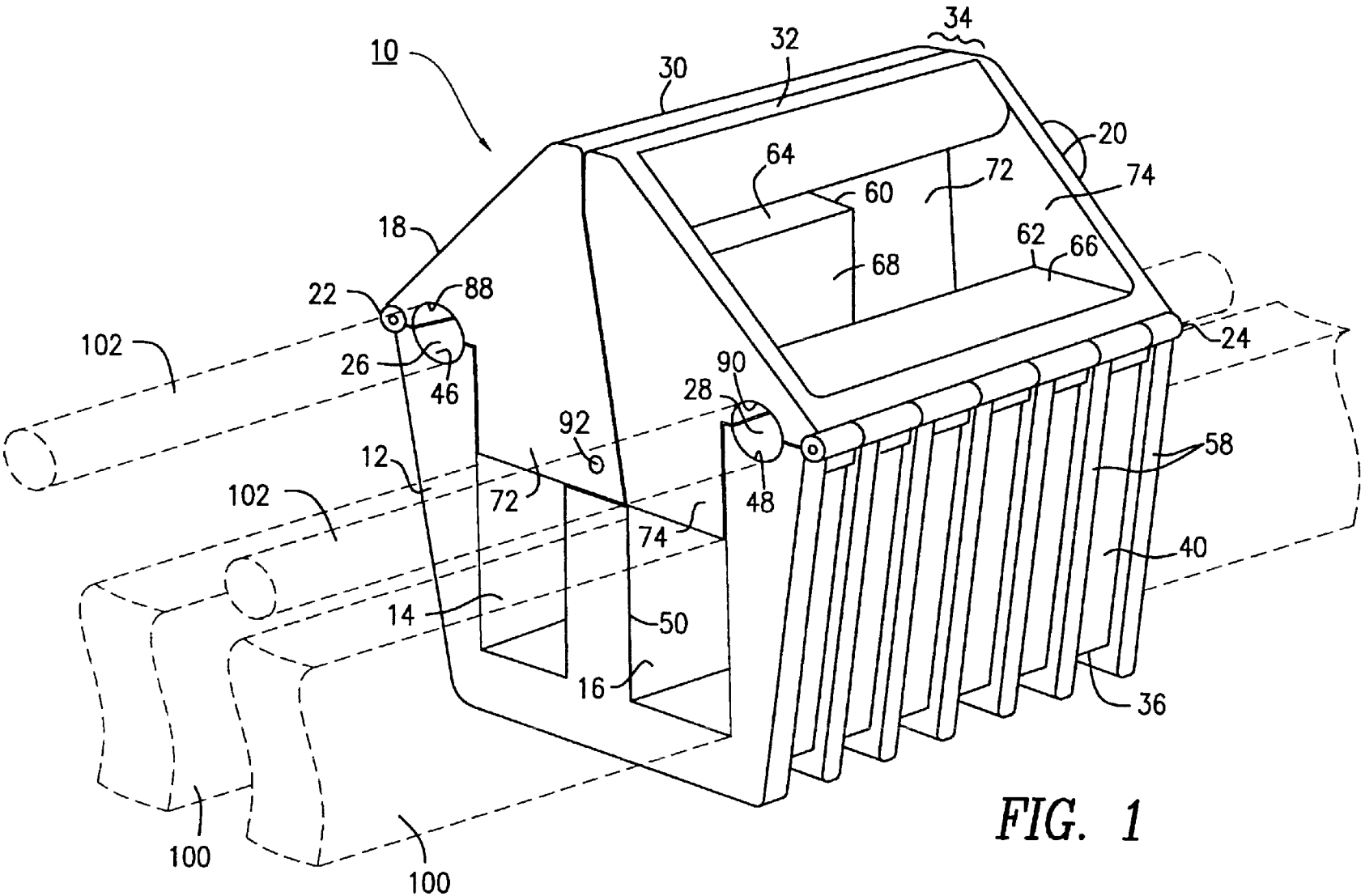
FIG. 1 is a perspective view of a hand-held ski and pole carrier according to a preferred embodiment of the invention with a pair of skis and a pair of poles shown fragmentarily and in phantom, in position in the appropriate compartments and ski pole clamping cavities of the carrier.
Figure 2:
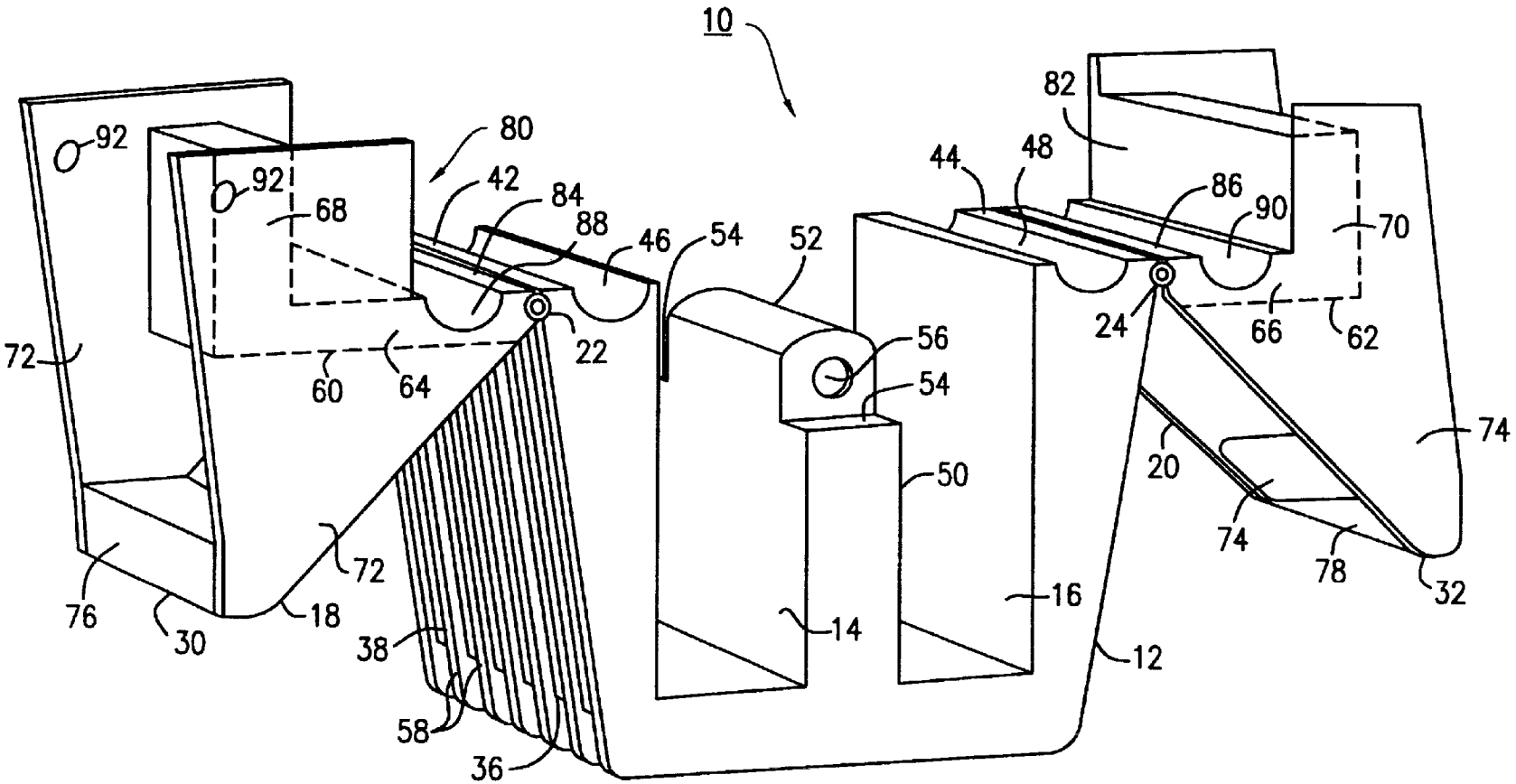
FIG. 2 is a perspective view of the hand-held ski and pole carrier of FIG. 1 shown with its closures in the open position.

FIGS. 1 and 2 show a hand-held carrier 10 for carrying skis and associated ski poles according to a preferred embodiment of the invention. The carrier 10, as set forth more particularly herein below, comprises a w-shaped open ended receptacle 12 defining first and second elongated compartments 14, 16 each sized for holding the section of a ski which mounts the ski-boot binding hardware (not shown). The carrier 10 further comprises first and second closures 18, 20 pivotally coupled to the receptacle 12 with integrally formed hinges 22, 24. The closures 18, 20 respectively close off the tops of the first and second compartments 14, 16. The receptacle 12 and closures 18, 20 define generally cylindrical first and second cavities 26, 28 for clamping a pair of ski poles (not shown) in the carrier 10. The closures 18, 20 further include integral handle sections 30, 32 which come together to form a single carrying handle 34 when the closures 18, 20 are pivoted to close off the tops of the compartments 14, 16.

The details of the w-shaped open ended receptacle 12 include a bottom wall 36 bounded by a pair of upstanding parallel side walls 38, 40. Each side wall 38, 40 includes an upper edge surface 42, 44 with a recess 46, 48 extending longitudinally from one end of the receptacle 12 to the other. These side wall recesses 46, 48 form the receptacle defined portion of the cylindrical ski pole clamping cavities 26, 28. A central partition wall 50 extending parallel to the side walls 38, 40 projects up from the bottom wall 36 to divide the interior of the receptacle 12 into the two compartments 14, 16. The upper portion 52 of the partition wall 50 is typically rounded and has relief notches 54 at each end thereof for enabling the exterior end surfaces of the second closure 20 to be flush with the exterior end surfaces of the partition wall 50 when the closure 20 is closed. The upper portion 52 of the partition wall 50 also has a longitudinal cable lock aperture 56 extending therethrough. The side and the bottom walls 38, 40, 36 of the receptacle 12 are reinforced with a plurality of integrally formed ribs 58.

In more detail, the closures 18, 20 include L-shaped closure portions 60, 62 integrally formed with the handle sections 30, 32. Each L-shaped closure portion 60, 62 defines a horizontal top wall 64, 66 and an inner wall 68, 70 depending from the top wall 64, 66. The handle sections 30, 32 are each constructed with two roughly triangular-shaped support members 72, 74 integrally formed with the ends of their respective closure portion 60, 62, and a handle member 76, 78 extending between the upper ends of the support members 72, 74. The outer lower corners of the support members 72, 74 include notches 80, 82 which together with their respective closure portion top walls 64, 66 define closure edge surfaces 84, 86. Each closure edge surface 84, 86 has a recess 88, 90 extending longitudinally between the ends of the closure 18, 20. The recesses 88, 90, 46, 48 defined in the closures 18, 20 and the receptacle 12 form the two ski pole clamping cavities 26, 28 when the closures 18, 20 are in a closed relation with the receptacle 12.

Figure 3:
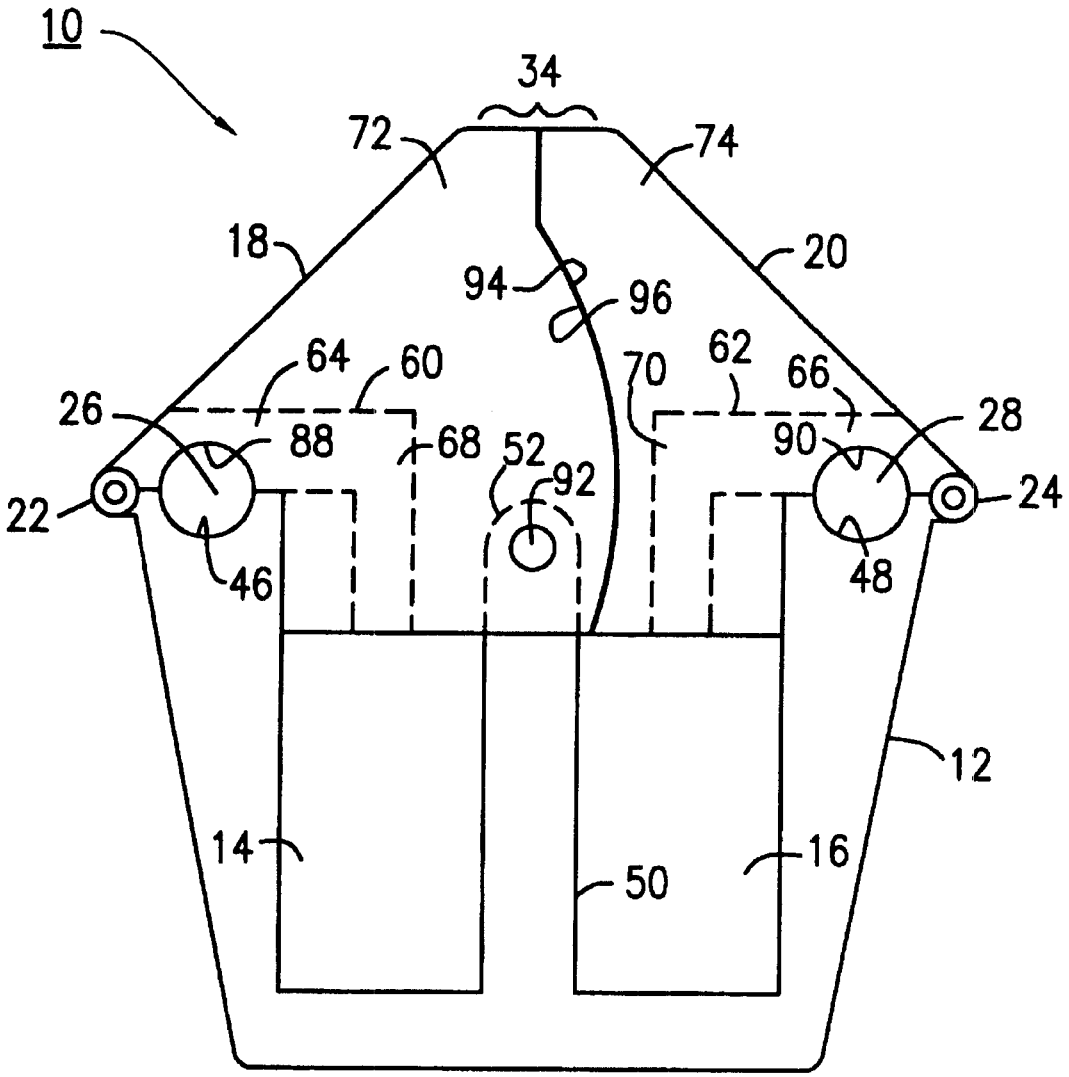
FIG. 3 is an end elevational view of the carrier of FIG. 1.

As shown in FIG. 3, the handle support members 72 of the first closure 18 are wider than the handle support members 74 of the second closure 20, and include apertures 92. When the closures 18, 20 are closed, the wider handle support members 72 of the first closure 18 overlap the upper portion 52 of the partition wall 50 and the support member apertures 92 axially align with the longitudinal cable lock aperture 56 thereby allowing a conventional cable lock (not shown) to be inserted therethrough to lock the first closure 18 in the closed position. The support members 72, 74 of the closures 18, 20 also include complimentary arcuate inner edge surfaces 94, 96 which facilitate smooth opening and closing of the closures 18, 20. This arrangement requires sequential opening and closing of the closures 18, 20 thereby advantageously permitting the first closure 18 to be used for locking the second closure 20 as the first closure 18 must be pivoted to the open position first (after removing the cable lock) in order to pivotally open the second closure 20.

The closures 18, 20 and receptacle 12 of the carrier 10 can be manufactured from any suitable material although a plastic such as ABS is preferred because it allows each of these three components to be molded using conventional plastic molding techniques.

Figure 4:
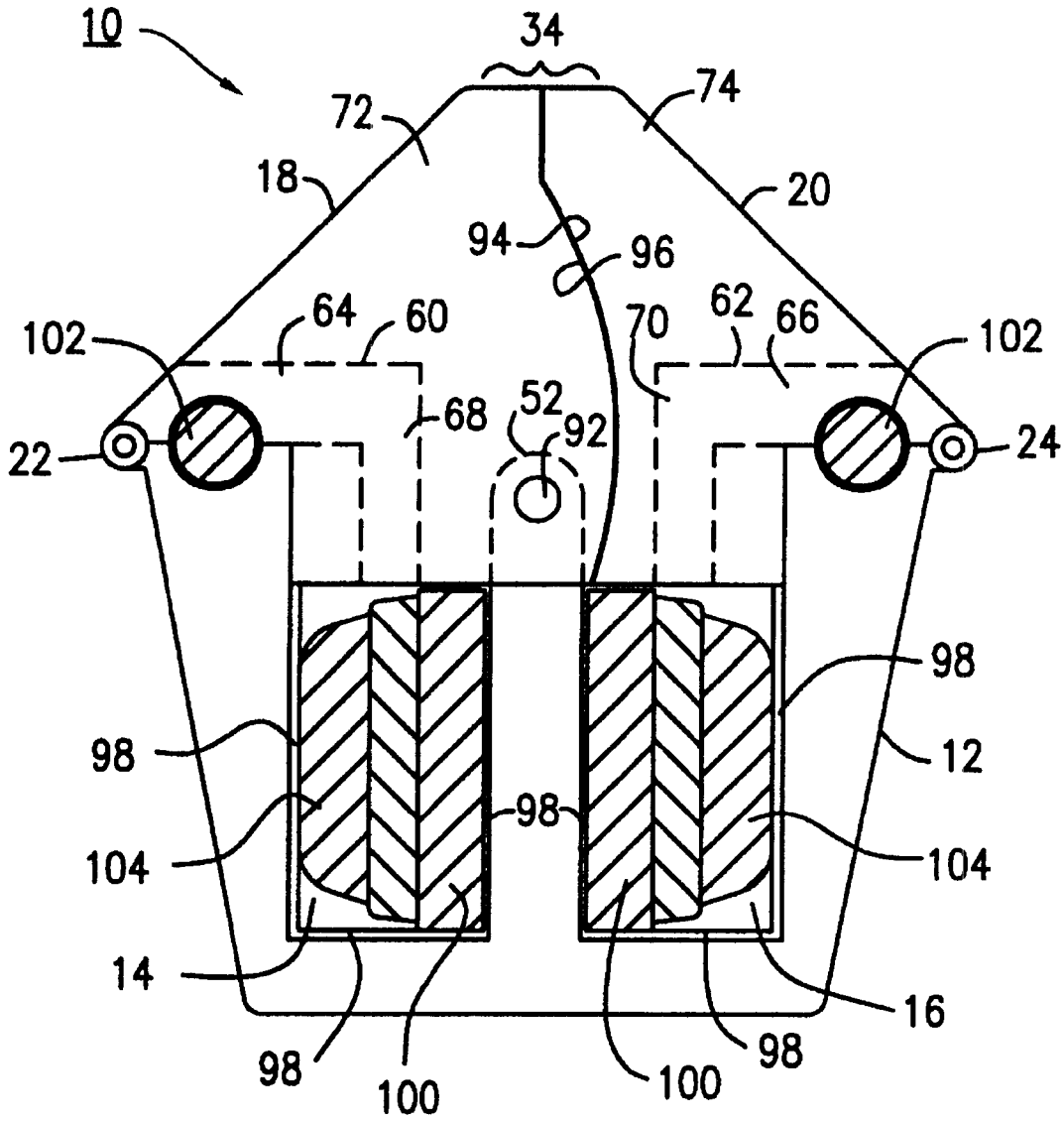
FIG. 4 is an end elevational view of the carrier of FIG. 1 with skis and poles (shown in cross-section) in position in the appropriate compartments and ski pole clamping cavities of the carrier.

FIGS. 1 and 4 show a pair of skis 100 and a pair of ski poles 102 appropriately secured in the carrier 10. As shown in FIG. 4, the interior of each compartment 14, 16 can be lined with padding 98 made from foam, soft rubber or any other equivalent material to aid in holding the skis 100 in place and avoid slippage during transportation. The padding 98 also allows the compartments 14, 16 of the carrier 10 to be "sized" for accommodating virtually all conventional ski widths including state of the art boot lifts 104 (which elevate the ski boots higher above the top surfaces of the skis than normal) that are presently used with parabolic skis.

It should now be apparent that the carrier 10 of the invention enables one to easily transport skis from one location to another. Moreover, the hinged closures 18, 20 disposed above the openings of the compartments 14, 16 advantageously allow skis be simply dropped into the compartments 14, 16 rather than having to sandwich them into position as is required with conventional ski carriers.

While the foregoing invention has been described with reference to the above embodiment, various modifications and changes can be made without departing from the spirit of the invention. Accordingly, all such modifications and changes are considered to be within the scope of the appended claims.

What is claimed is:

1. A hand-held carrier for manually carrying parabolic skis and associated ski poles, the carrier comprising:

a double open-ended receptacle having a bottom wall, first and second side walls extending up from the bottom wall and a partition wall disposed between the side walls, the walls defining first and second elongated compartments each sized for holding a section of a ski and its associated ski-boot binding hardware;

first and second closures pivotally coupled to opposing upper portions of the receptacle, for respectively closing the first and second compartments, the closures including integral handle sections which come together to form a single carrying handle when the closures are pivoted to close the compartments; and first and second generally cylindrical cavities formed in abutting surfaces of the receptacle and closures for clamping a pair of ski poles to the carrier.

2. The carrier according to claim 1, wherein the receptacle includes a plurality of reinforcement ribs.

3. A hand-held carrier for manually carrying parabolic skis and associated ski poles, the carrier comprising:

a substantially rigid, double open-ended receptacle having a bottom wall, first and second side walls extending up from the bottom wall and a partition wall disposed between the side walls, the walls defining first and second elongated compartments each sized for holding a section of a ski and its associated ski-boot binding hardware; and first and second closures pivotally coupled to opposing upper portions of the receptacle, for respectively closing the first and second compartments, the closures including integral handle sections which come together to form a single carrying handle when the closures are pivoted to close the compartments, the closures pivotally coupled to the upper portions of the receptacle with hinges.

4. A hand-held carrier for carrying ski hardware, comprising:

a substantially rigid, receptacle having a bottom wall, first and second side walls extending up from the bottom wall and a partition wall disposed between the side walls, the walls defining first and second open-ended compartments each sized for holding at least a section of a ski; and first and second closures pivotally coupled to the receptacle with hinges, for respectively closing the first and second compartments, the closures including integral handle sections which form a single carrying handle when the closures are pivoted to close the compartments.

5. The carrier according to claim 4, further comprising first and second cavities formed by surfaces of the receptacle and closures for clamping a pair of ski poles to the carrier.

6. The carrier according to claim 4, wherein the skies are parabolic skis.

7. The carrier according to claim 4, wherein the receptacle and closures are molded from plastic.

8. The carrier according to claim 4, wherein the receptacle includes a plurality of reinforcement ribs.

9. The carrier according to claim 4, wherein the hinges are on opposing sides of the receptacle.

10. The carrier according to claim 4, further comprising first and second generally cylindrical cavities formed by portions of the receptacle and closures for clamping a pair of ski poles to the carrier.

* * * * *